United States Patent [19]

Buchanan

[11] 4,409,809

[45] Oct. 18, 1983

[54] DUAL MOTION PRESS

[75] Inventor: John A. F. Buchanan, Worcester, England

[73] Assignee: Superform Metals Ltd., England

[21] Appl. No.: 255,397

[22] Filed: Apr. 20, 1981

[30] Foreign Application Priority Data

Apr. 10, 1981 [GB] United Kingdom ..... 8111290

[51] Int. Cl.[3] ..... B21D 22/10

[52] U.S. Cl. ..... 72/60; 72/63; 29/421 R

[58] Field of Search ..... 72/60, 63, 54; 29/421 R

[56] References Cited

U.S. PATENT DOCUMENTS 4,045,986 9/1977 Laylock et al. ..... 29/421 R 4,266,416 5/1981 Festag et al. ..... 29/421 R

*Primary Examiner*—Francis S. Husar

*Assistant Examiner*—David B. Jones

*Attorney, Agent, or Firm*—Karl W. Flocks; Sheridan Neimark

[57] ABSTRACT

A machine for use in forming ductile metal sheets into shaped bodies having first and second open-ended, annular chambers which are relatively movable, while maintaining their open ends in register with one another, between a position in which the open ends meet and a position in which the open ends are spaced apart, a plate in at least one of the chambers which is movable independently of both chambers in directions parallel with the directions of relative movement between the chambers between a first position in which it constitutes a gas tight sealed base for said one chamber and a second position in which it is adjacent the open end of that chamber.

6 Claims, 4 Drawing Figures

DUAL MOTION PRESS

BACKGROUND OF THE INVENTION

This invention relates to apparatus for and a method of forming ductile metal sheets into shaped bodies. It is particularly although not exclusively concerned with the forming of so called superplastic metal alloys which under appropriate conditions of temperature and pressure exhibit high ductility and an ability to flow.

Many superplastic alloy sheets, particularly those with an aluminium base can at least in their superplastic condition, be formed by the application of a differential air pressure thereto. Simple female forming in which a sheet is deformed into an open mould is suitable for shallow, smoothly rounded shapes but may result in bodies having unacceptable variations in wall thickness. For deeper bodies or those of more complex shape particularly those having sharp corners or angular shapes it is usual to form the sheet over a male mould either in a single operation or as the last step of a multi-stage operation.

In a simple male forming operation the male mould is conveniently carried on a platen of a forming machine which platen must have a peripheral wall of greater depth than the mould to enable the metal sheet which is to be formed over the mould to be initially clamped around its periphery in spaced relationship to the mould. With this arrangement it is necessary for the periphery of the mould to be spaced significantly inwardly from the wall in order to ensure a smooth flow of the sheet material around the base of the mould. This is wasteful of material since the original flat sheet must be significantly larger than the mould.

It is also known, for example in the so-called "snap back" technique to clamp a sheet of superplastic metal alloy around its periphery, hold the sheet at a forming temperature, form a bubble in the sheet by applying a differential air pressure thereto, advance a male mould into the cavity of the bubble and reverse the pressure differential to form the sheet against the mould. If air under pressure is used to form the bubble such an operation requires establishing a sealed chamber on each side of the sheet and moving a carrier for the mould within one of the chambers. Forming machines for this purpose usually have a mould carrier in the form of a movable platen and this inevitably results in sealing problems where the drive for the platen passes through its associated chamber wall.

It is accordingly an object of the present invention to provide an improved press for use in forming ductile metal sheets into shaped bodies which is particularly flexible in operation. A further object is to provide an improved method of forming ductile metal sheets into shaped bodies using a "snap back" technique.

BRIEF SUMMARY OF THE INVENTION

According to one aspect of the present invention there is provided a machine for use in forming ductile metal sheets into shaped bodies having first and second open-ended, annular chambers which are relatively movable, while maintaining their open ends in register with one another, between a position in which the open ends meet and a position in which the open ends are spaced apart, a plate in at least one of the chambers which is movable independently of both chambers in directions parallel with the directions of relative movement between the chambers between a first position in which it constitutes a gas tight sealed base for said one chamber and a second position in which it is adjacent the open end of that chamber.

Preferably the first chamber is formed as or carried by the upper platen of a press and has a downwardly extending peripheral wall the lower end of which is arranged to carry any one of a plurality of annular plates having differing internal shapes and dimensions. The second chamber may comprise an annular wall of generally the same transverse dimensions and shape as the peripheral wall the upper end of the annular wall being arranged to carry any one of said annular plates and the lower end of the annular wall comprising a first annular, lower platen of the press. The plate may constitute or be carried by a second lower platen of the press. Preferably a seal is disposed on the upper surface and adjacent the internal periphery of the first lower platen to be engaged by an edge region of the lower surface of the plate.

According to another aspect of the present invention there is provided a method of forming a ductile metal sheet into a shaped body in a machine according to the penultimate paragraph comprising disposing a male mould on the plate with the latter in its first position, clamping the periphery of the sheet in a gas tight manner between the chambers to extend across the open ends thereof, maintaining at least the sheet and the mould at temperatures each within a range of suitable forming temperatures, creating a gas pressure differential between the chambers in the sense to form the sheet into a bubble projecting into the other chamber, moving the plate towards its second position so that the mould is inserted into the concave side of the bubble and the chamber containing the plate communicates with the atmosphere and increasing the gas pressure in the other chamber to force the material of the bubble into intimate contact with the mould. Preferably completion of the movement of the plate into its second position occurs at the same time as the increase in gas pressure in the other chamber.

BRIEF DESCRIPTION OF THE DRAWINGS

The above and other aspects of the invention will now be described by way of example with reference to the accompanying drawings in which.

DETAILED DESCRIPTION OF INVENTION

Figure 2:
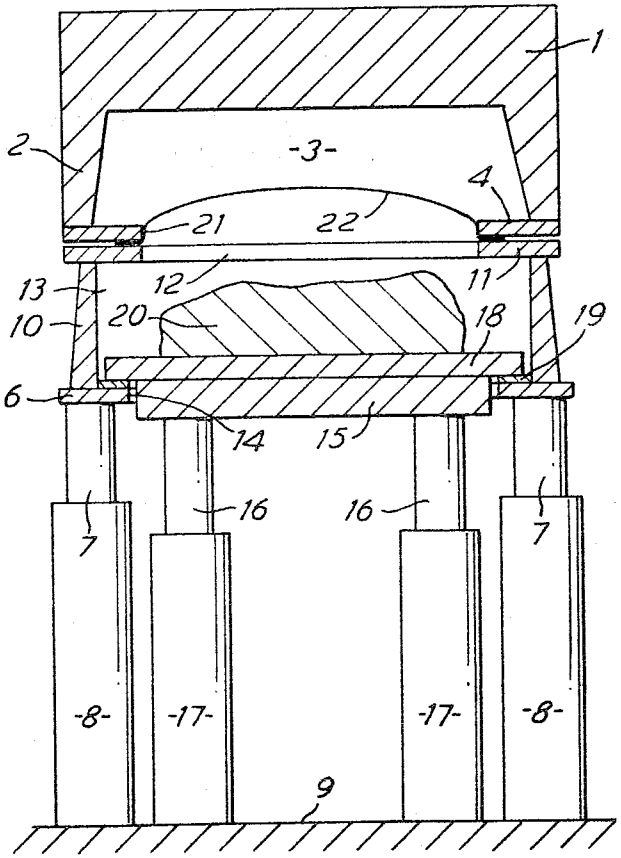
FIGS. 1 to 4 show, diagrammatically, in elevation a forming machine according to the invention in different stages of a typical operating cycle.

Referring to the drawings a forming machine comprises a press having a fixed upper platen 1 with a downwardly extending peripheral wall 2 to define a first chamber 3. A modular plate 4 having an opening 5 is secured in gas tight manner to the lower end of the wall 2. A lower platen 6 of the press is carried by the rams 7 of hydraulic motors such as 8 mounted on a base 9. An annular wall 10 of generally the same transverse dimensions and shape as the wall 2 is mounted on the lower platen 6 and carries at its upper end a modular plate 11 having an opening 12. The space within the annular wall 10 constitutes a second chamber 13 the upper open end of which is in register with the lower open end of the chamber 3. By activating the motors 8 the chamber 13 is movable towards and away from the chamber 3.

The lower platen 6 is annular with a central aperture 14 to receive, with clearance, a second lower platen 15 of the press carried by the rams 16 of hydraulic motors 17 also mounted on the base 9. The second lower platen 15 carries a plate 18 which overlaps the inner periphery of the platen 6 and the latter has an annular gasket 19 on its upper surface.

The chambers 3 and 13 are provided with suitable connections (not shown) through which they may be supplied with gas under pressure or evacuated as may be desired.

Figure 1:
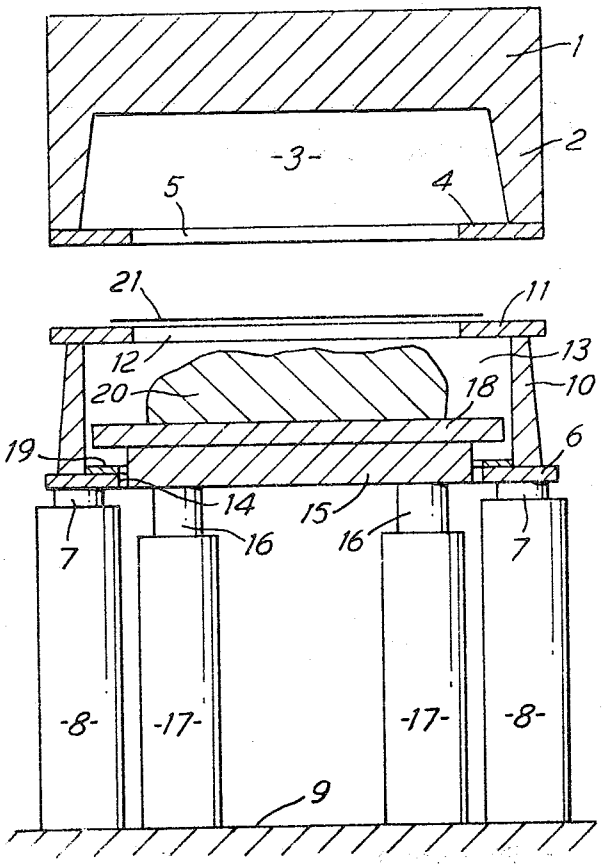

As shown in FIG. 1 a male mould 20 is secured to the table 18. It will be understood that the similar openings 5 and 12 in the modular plates 4 and 11 are greater in size than, but of similar shape to, the shape in plan of the mould 20. A sheet 21 of ductile metal to be formed is placed on the plate 11 overlapping its aperture 12. The sheet 21, the plates 4 and 11 and the mould 20 are all maintained at a suitable forming temperature. When the sheet 21 is of a ductile aluminium alloy, for example an alloy capable of being super plastically deformed, this temperature may be up to 1200° C.

The motors 8 are then actuated to drive the rams 7 upwards until the sheet 21 is clamped tightly between the plates 4 and 11. During this upward movement the lower platen 6 engages the plate 18 with the intermediary of the gasket 19 to carry the plate 18 and the mould 20 upwards to the position shown in FIG. 2. In this position the chamber 3 is sealed by the sheet 21 and the chamber 13 is sealed at its upper end by the sheet 21 and at its lower end by the plate 18.

A differential gas pressure is then created between the chambers in the sense to form the sheet 21 into a bubble 22 projecting into the chamber 3. This is most conveniently done by supplying gas under pressure to the chamber 13 while the chamber 3 is connected to atmosphere. Alternatively the pressure in the chamber 3 could be lowered while the chamber 13 is connected to atmosphere or supplied with gas under pressure.

Figure 3:
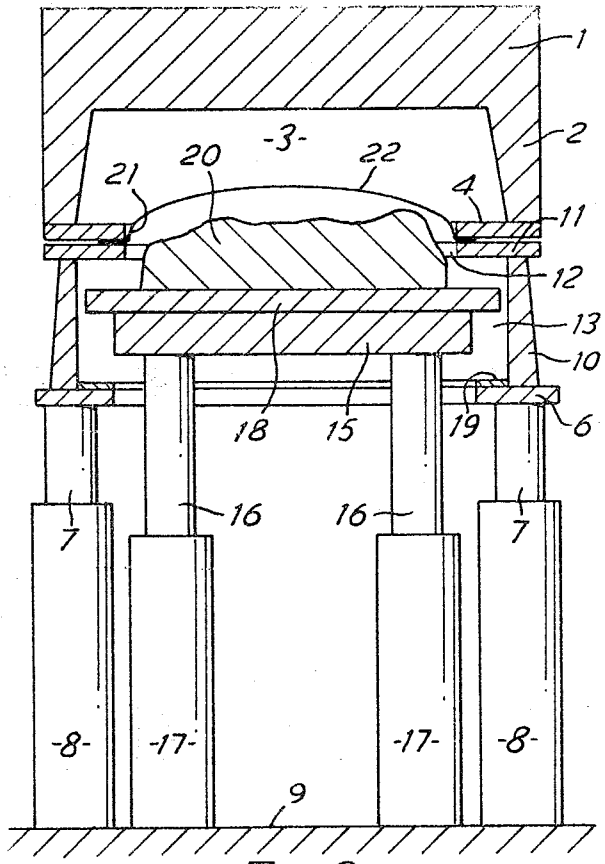

Any pressure in chamber 13 is then evacuated to atmosphere and the motors 17 are actuated to drive their rams 16 upwards and move the plate 18 from the position shown in FIG. 2 to the position shown in FIG. 3 where the upper part of the mould 20 is about to touch the lower surface of the bubble 22.

Figure 4:
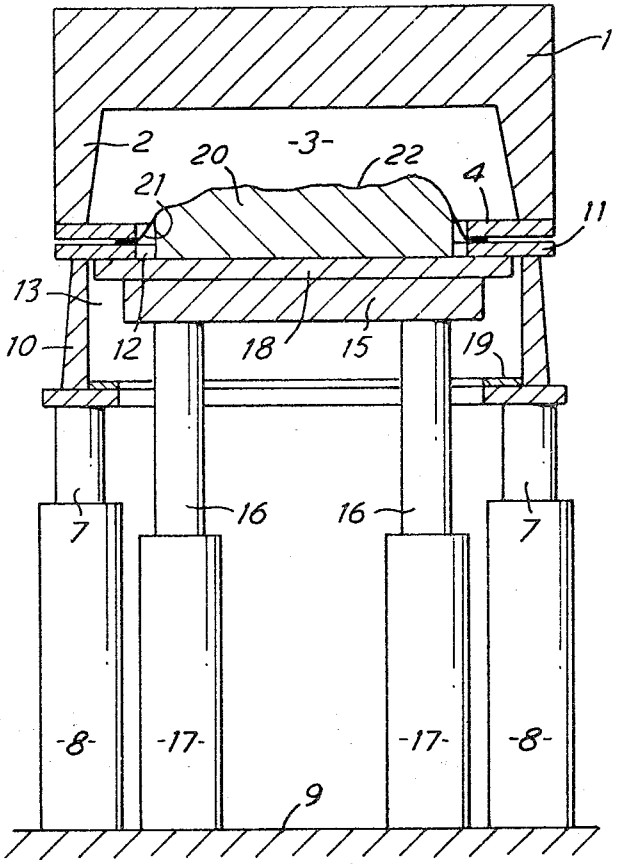

As the rams 16 move the plate 18 further towards its uppermost position (FIG. 4) gas under pressure is supplied to the chamber 3 so as to force the material of the bubble 22 into intimate contact with the upper surface of the mould 20 (FIG. 4)

After exhaustion of chamber 3 both sets of motors 8 and 17 are then de-energized so that the platens 6 and 15 descend to their lowermost positions and the formed article is removed from the press.

It will be understood that with the arrangement above described little wastage of the sheet 21 will occur because the size of the openings 5 and 12 is little greater than the size in plan of the mould 20. Furthermore the provision of the annular wall 10 ensures that should the material of the bubble 22 fail during the final stage of the forming process the press operator is shielded from the discharge of high pressure gas and metallic particles at high temperature.

In a typical installation where the pressure used in the chamber 3 is up to 10 atmospheres the platens 6 and 15 would each be powered by eight rams 7 and 16 to be capable of exerting a pressure of 450 tonnes on each platen.

It will also be appreciated that the plate 18 could be provided in the fixed upper chamber 3. Alternatively plates 18 could be provided in both chambers and the latter could, if desired both be movable. Such arrangement could facilitate performance of the methods of forming disclosed in our earlier United Kingdom Pat. Nos. 1,461,317 and 1,552,826.

In addition, although as described the press is arranged for vertical operation it could be arranged for horizontal movement.

I claim:

1. A machine for use in forming ductile metal sheets into shaped bodies having first and second open-ended annular chambers, means for relatively moving the chambers while maintaining their open ends in register with one another between a position in which the open ends are spaced apart to permit a metal sheet to be inserted therebetween and a position in which the open ends clamp the periphery of the sheet in a gas tight manner therebetween, a mould plate in the first chamber arranged to carry a mould on a surface thereof nearest the second chamber, means for moving the mould plate independently of both chambers in directions parallel with the directions of relative movement between the chambers from a first position in which it constitutes a gas tight sealed base for the first chamber to a second position in which a mould carried by the plate extends within the open end of the second chamber.

2. A machine according to claim 1 comprising heating means for maintaining at least the metal sheet and the mould at temperatures each within a range of suitable forming temperatures, gas pressure means capable of creating a gas pressure differential between the chambers, when the mould plate is in its first position, in the sense to form the sheet into a bubble projecting into the second chamber and capable of increasing the gas pressure in the second chamber when the mould plate is in its second position, in which the mould projects within the concave side of the bubble and the first chamber communicates with the atmosphere so that the material of the bubble is forced into intimate contact with the mould.

3. A machine according to claim 1 in which the second chamber is formed as or carried by the upper platen of a press and has a downwardly extending peripheral wall the lower end of which is arranged to carry any one of a plurality of annular plates having differing internal shapes and dimensions.

4. A machine according to claim 3 in which the first chamber comprises an annular wall of generally the same transverse dimensions and shape as the peripheral wall the upper end of the annular wall being arranged to carry any one of said annular plates and the lower end of the annular wall comprising a first annular, lower platen of the press.

5. A machine according to claim 4 in which the mould plate constitutes or is carried by a second lower platen of the press.

6. A machine according to claim 5 in which a seal is disposed on the upper surface and adjacent the internal periphery of the first lower platen to be engaged by an edge region of the lower surface of the mould plate.

* * * * *